US005369817A

United States Patent [19]

Iguchi

[11] Patent Number: 5,369,817

[45] Date of Patent: Dec. 6, 1994

[54] TOILET SEAT BOX

[75] Inventor: Masahiro Iguchi, Aichi, Japan

[73] Assignee: Inax Corporation, Tokoname, Japan

[21] Appl. No.: 45,852

[22] Filed: Apr. 12, 1993

[30] Foreign Application Priority Data

Apr. 16, 1992 [JP] Japan ..... 4-024311[U]

[51] Int. Cl.[5] ..... A47K 7/08

[52] U.S. Cl. ..... 4/448; 4/443; 4/420.4; 251/288

[58] Field of Search ..... 4/420, 420.1–420.4, 4/443–448; 251/248, 288, 293

[56] References Cited

U.S. PATENT DOCUMENTS

| | | | |
|---|---|---|---|
| 1,181,565 | 5/1916 | Block | 251/293 |
| 1,663,111 | 3/1928 | Campus . | |
| 3,582,116 | 6/1971 | Young | 251/293 |
| 4,082,247 | 4/1978 | Dalton | 251/248 |
| 4,178,816 | 12/1979 | Radice | 251/248 |
| 4,237,560 | 12/1980 | Kiegelman et al. | 4/447 |
| 4,307,868 | 12/1981 | Morin | 251/248 |
| 4,538,789 | 9/1985 | An | 251/248 |
| 4,581,779 | 4/1986 | Matsui et al. | 4/448 |
| 4,616,368 | 10/1986 | Nagas et al. | 4/420.4 |
| 4,753,418 | 6/1988 | Brotcke | 251/288 |

FOREIGN PATENT DOCUMENTS

| | | |
|---|---|---|
| WO-A-8501765 | 4/2585 | WIPO . |

*Primary Examiner*—Henry J. Recla
*Assistant Examiner*—Gregory Vidovich
*Attorney, Agent, or Firm*—Kanesaka & Takeuchi

[57] ABSTRACT

A toilet seat box device to be mounted on the rear part of the top of a toilet contains a nozzle for spraying washing water onto the buttocks of the person using the toilet and a water flow adjustment valve for adjusting the flow of water supplied to the nozzle. The toilet box device has a projecting part on one side which projects toward the front of the toilet. A washing strength dial for operating the water flow adjustment valve is located on the side of the projecting part, and an axle rotated by the dial is mechanically connected to the water flow adjustment valve by gears.

6 Claims, 3 Drawing Sheets

TOILET SEAT BOX

BACKGROUND OF THE INVENTION

1. Field of the Invention

This invention relates to a toilet seat box or device to be mounted on the top of a toilet, and more particularly to a toilet seat box to which a toilet seat is attached. Still more particularly, it relates to an improvement in a toilet seat box which contains a warm water washing apparatus for washing the buttocks of the user with a spray of warm water.

2. Description of the Related Art

In a conventional toilet incorporating a warm water washing device as shown in FIG. 2, a toilet seat box 52 is mounted at the rear of a toilet seat 51, and inside the box 52, a warm water tank 53 is formed. In front of the tank, a washing nozzle 53 is mounted, such that washing water can be sprayed from the nozzle 54 onto the buttocks of the toilet user. To adjust the amount of warm water sprayed from the nozzle 54, a washing strength dial 55 is fitted on top of the side part of the box 52, projecting upwards. Reference numeral designates 56 is a toilet lid.

Thus, in the prior art products, because the washing strength dial 55 projects form the top of the toilet seat box, there is the problem of appearance of the toilet.

As a solution to this kind of problem in conventional designs, in Japanese Laid-Open Utility Model Publication No. H3-5078, (hereinafter referred to as the previous application), a toilet seat box for attachment to the rear part of a toilet seat and containing a washing nozzle and a water flow adjustment valve to adjust the flow of water supplied to the nozzle was proposed by the present applicant, wherein a toilet seat box is provided with a washing strength dial for adjusting the water flow adjustment valve at a side of the box.

In positioning the parts inside the toilet seat box, in some cases it is necessary to position the dial away from the water flow adjustment valve. In these cases, it is necessary to transmit the motions of the dial reliably to the water flow adjustment valve.

When a projecting part which projects toward the front of the toilet and which is tapered such that its vertical thickness decreases toward the front of the toilet (referred to below as tapered), is incorporated into one side of the toilet seat box, because the internal volume of the end of the projecting part is small, the water flow adjustment valve cannot be mounted inside the end of the projecting part. On the other hand, positioning the dial as close as possible to the end of this projecting part is convenient to use by the toilet user sitting on the toilet seat. For these reasons if the tapered projecting part is formed the dial and water flow adjustment valve are situated in different locations, and a reliable mechanical connection between them becomes necessary.

OBJECT AND SUMMARY OF THE INVENTION

An object of this invention is to provide a toilet seat box which has a neat appearance and moreover the dial of which can be easily reached and turned by hand by the person sitting on the toilet seat.

In accordance with a first aspect of the invention, a toilet seat box for mounting on the rear part of the top of a toilet contains a nozzle for spraying washing water onto the buttocks of the person using the toilet and a water flow adjustment valve for adjusting the flow of water supplied to this nozzle. The toilet box has a projecting part on one side which projects toward the front of the toilet. A washing strength dial for operating the water flow adjustment valve is located on the side of the projecting part, and a shaft rotated by the dial is mechanically connected to the water flow adjustment valve by a gear.

In accordance with a second aspect of the invention, the projecting part of the toilet box is tapered such that its vertical thickness decreases toward the front, and the above-mentioned dial is located near the end of the projecting part.

In accordance with a third aspect of the invention, the above-mentioned shaft comprises two parts. One of the these parts has a plug part projecting axially from the main body of the part, and the other part has a corresponding socket into which the projecting plug part fits.

In the case of the toilet seat box of this invention also, as in that of the previous application, because the washing strength dial is fitted such that it projects from the side of the toilet seat box, the washing strength dial is in an unobtrusive position, and the toilet seat box can be given a neat appearance with no protrusions on the top of the operation box.

In this invention, because the motions of the dial are transmitted to the water flow adjustment valve by the gears, the water flow adjustment valve located away from the dial can be reliably operated.

According to the second aspect of the invention mentioned above in particular, because the projecting part is tapered, the projecting part is inconspicuous, and this also contributes to a marked improvement in the appearance of the toilet seat box.

According to the third aspect of the invention mentioned above, therefore expansion and construction of the toilet seat box and the axle, and dimensional errors, are tolerated.

DESCRIPTION OF THE PREFERRED EMBODIMENT

A preferred embodiment of this invention will now be described below with reference to the drawings.

Figure 1:
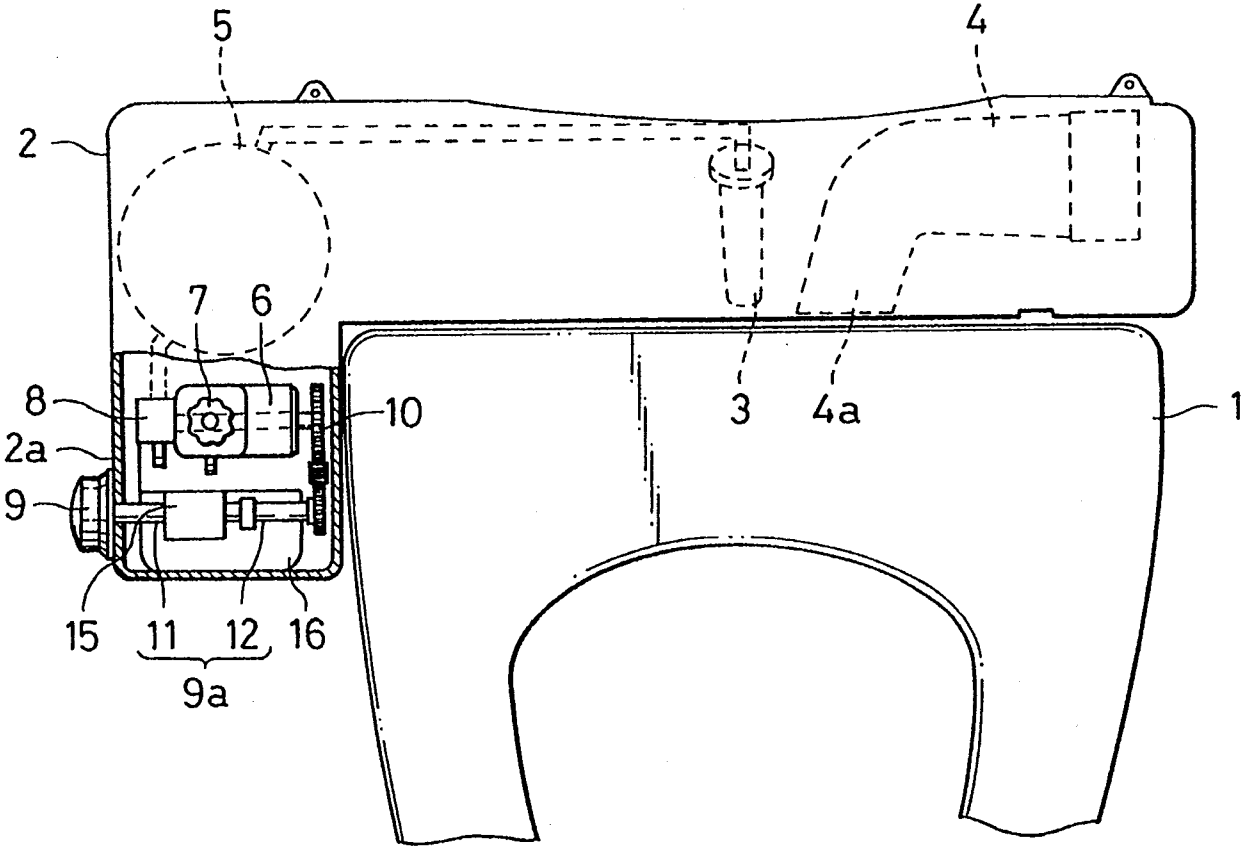
FIG. 1 is schematic plan view of a toilet seat box in accordance with a preferred embodiment of this invention.
Figure 2:
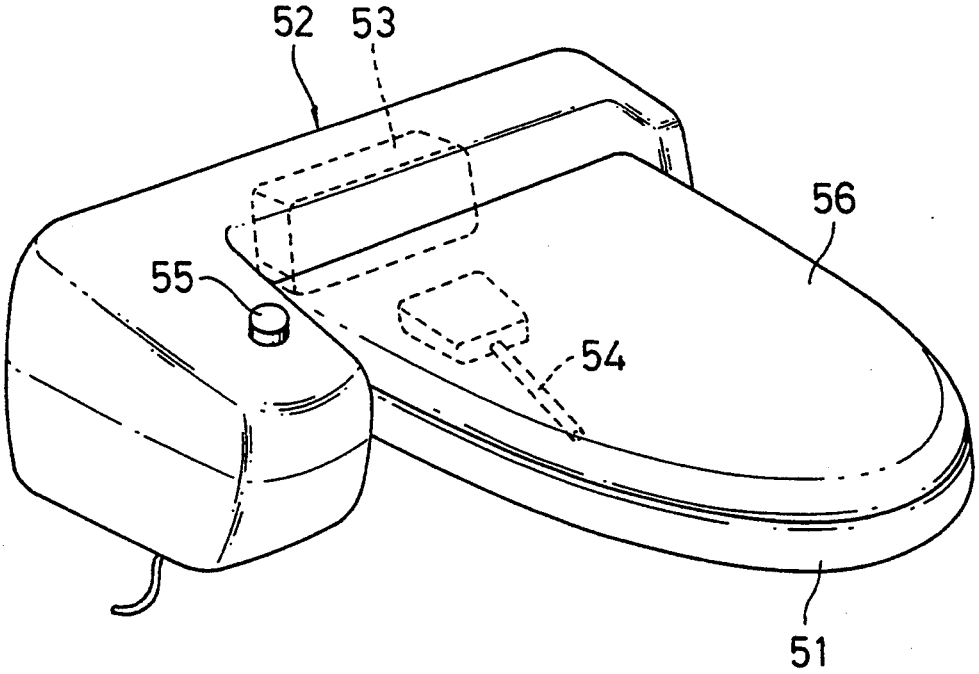
FIG. 2 PRIOR ART
FIG. 2 is a perspective view of a prior art toilet seat box.

FIG. 1 is a schematic plan view of an operation box according to this invention. Toilet seat box 2, to which a toilet seat 1 is pivotally attached, is mounted at the rear of toilet seat 1. Washing nozzle 3 is mounted in the central part of the inside of the toilet seat box 2, and a warm air fan 4 with an outlet *4a*, which blows warm air onto the buttocks of the toilet user, is mounted to one side of that nozzle 3. Warm water tank 5 is mounted in the part of the toilet seat box on the left side portion of FIG. 1, and in front of that, an electromagnetic valve 6 and a pressure regulator valve 7 and a water flow adjustment valve 8 are connected up in a line as one unit and mounted inside a projecting part *2a*.

A rotary shaft 9a is provided parallel to the water flow adjustment valve 8. The rotary shaft 9a extends in the direction of the width of the toilet seat 1. One end of the shaft 9a passes through the outer side of the toilet seat box 2 and projects out from the box 2. A washing strength dial 9 is fitted to this end of the shaft 9a. Washing strength dial 9 is exposed on the side of toilet seat box 2. The shaft 9a of the washing strength dial 9 is connected by gears 10 to the water flow adjustment valve 8 such that by turning the dial 9 by hand, it is possible to adjust water flow adjustment valve 8 through the gears 10. The projecting part 2a is tapered toward its top and the dial 9 is located on the side of the end part of projecting part 2a. The shaft of the water flow adjustment valve 8 is positioned parallel to the shaft 9a.

When a washing apparatus switch is pressed, the electromagnetic valve 6 opens to allow city water to flow in and after the pressure is regulated to a predetermined level by the pressure regulator valve 7, the water flow is adjusted to the desired level by water flow adjustment valve 8, and the water flows through a vacuum breaker (not shown in the drawing) into the warm water tank 5.

In this preferred embodiment, the washing strength dial 9 is not positioned above the water flow adjustment valve 8 and does not project from the top of the toilet seat box 2 as it does in prior art products. Instead, the washing strength dial 9 projects out sideways from the side of the toilet seat box 2, and is in a position in which it is difficult to see. As a result, there are no protrusions on the top surface of toilet seat box 2, and the external appearance as seen from above the toilet seat box 2 becomes very neat.

Also, because the shaft 9a and the water flow adjustment valve 8 are connected by the gears 10, the turning motions of the dial 9 are accurately transmitted to the water flow adjustment valve 8.

Figure 3:
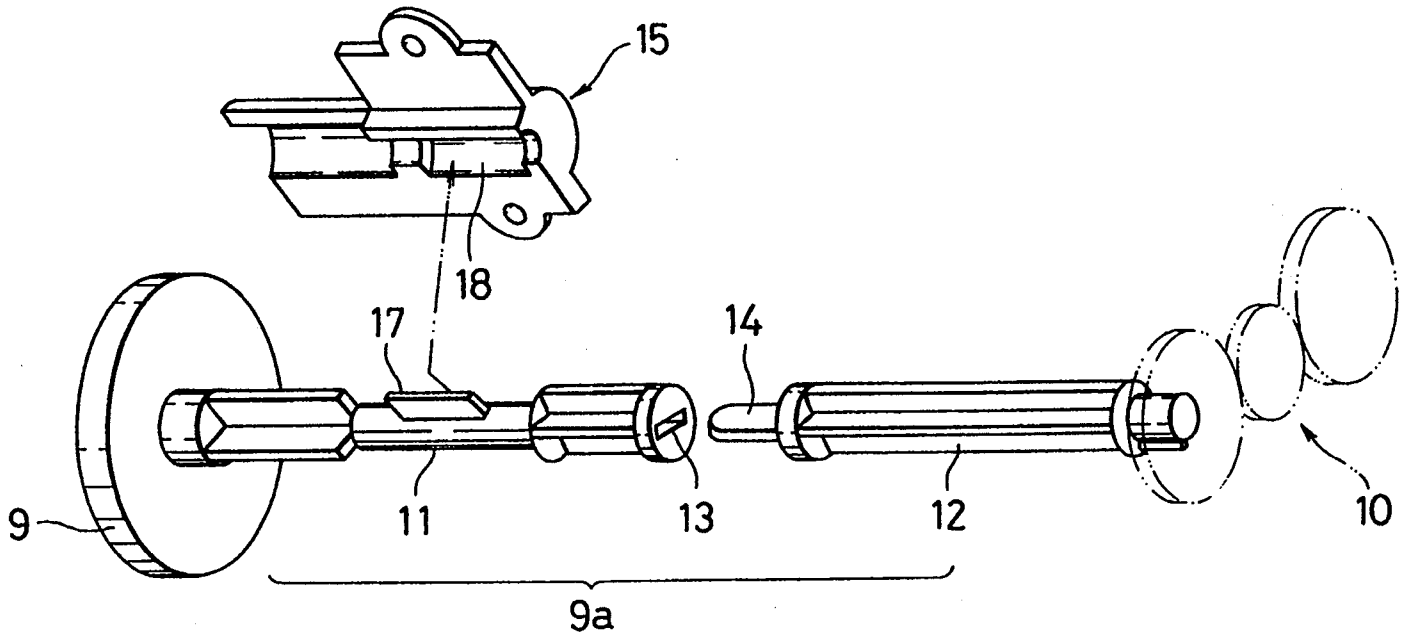
FIG. 3 is an exploded perspective view showing the construction of a rotary shaft *9a*.

Furthermore, as shown in FIG. 3, the rotary shaft 9a comprises two parts 11 and 12. At the top end of the part 11, there is a rectangular socket 13, and at the rear end of the part 12, there is a rectangular plug 14. The plug 14 fits into the socket 13 and the motions of the dial 9 are thereby transmitted to the part 12. Because of the existence of the plug and socket joint, the parts 11 and 12 have some slight freedom of movement in the axial direction. As a result, thermal expansion and dimensional errors in toilet seat box 2 and the shaft parts 11 and 12 are tolerated.

The shaft part 11 is pivotally supported by a rotary shaft support 16 in toilet seat box 2 (see FIG. 1) through a stop member 15. A riblike projection 17 is included in the part 11 and this projection 17 projects into a concave portions 18 of the stop member 15 so that the range of rotation of the part 11 is restricted to the range through which the riblike projection 17 can move in the concave portion 18.

In the toilet seat box according to this invention, the washing strength dial which projects from the side of the toilet seat box is inconspicuous and the upper surface of the toilet seat box has no projections so that an operation box with a neat external appearance can be formed and the toilet seat box can have an extremely favorable external configuration in its entirety. Further, the rotating power of the dial can be accurately transmitted to the water flow adjusting valve.

Further, the toilet seat box of this invention can make its external appearance more attractive by tapering its projecting part toward the top end thereof.

In addition, the washing strength dial can be easily turned, even if there are thermal expansion of parts and dimensional errors.

What is claimed is:

1. A toilet seat box device comprising:

a housing adapted to be mounted on a rear top part of a toilet bowl having a toilet seat and having a projecting part having outer top, bottom and sidewalls thereof disposed on one side of the toilet bowl and projecting toward a front of the toilet bowl, a washing nozzle for spraying washing water onto the buttocks of a person using the toilet bowl, said washing nozzle being fixed to the housing;

a water flow adjustment valve operatively connected to said nozzle for adjusting a flow of water supplied to the washing nozzle, said water flow adjustment valve being mounted in the housing;

a washing strength dial disposed on said outer side wall of said projecting part for operating said water flow adjustment valve;

a rotary shaft connected to said washing strength dial and situated in said projecting part to extend in a direction of the width of the toilet seat; and gears situated in the projecting part to connect said rotary shaft to said water flow adjustment valve for transmitting rotary motions of said dial to said water flow adjustment valve to thereby adjust the flow of water sprayed from the washing nozzle.

2. A toilet seat box device according to claim 1, wherein a first end of said rotary shaft projects outside the housing and wherein said washing strength dial is fitted to this end of said rotary shaft.

3. A toilet seat according to claim 1, wherein the water flow adjustment valve has an axle disposed parallel to said rotary shaft.

4. A toilet seat box device comprising:

a housing adapted to be mounted on a rear top part of a toilet bow having a toilet seat and having a projecting part having outer top, bottom and sidewalls thereof disposed on one side of the toilet bowl and projecting toward a front of the toilet, a washing nozzle for spraying washing water onto the buttocks of a person using the toilet bowl, said washing nozzle being fixed to the housing;

a water flow adjustment valve operatively connected to said nozzle for adjusting a flow of water supplied to the washing nozzle, said water flow adjustment valve being mounted in the housing;

a washing strength dial disposed on an said outer side wall of said projecting part for operating said water flow adjustment valve;

a rotary shaft connected to said washing strength dial and situated in said projecting part, said rotary shaft including parts, one of which has an axially projecting plug part, and the other of which has a socket into which said plug part fits; and gears situated in the projecting part to connect said rotary shaft to said water flow adjustment valve for transmitting rotary motions of said dial to said water flow adjustment valve to thereby adjust the flow of water prayed from the washing nozzle.

5. A toilet seat box device according to claim 4, wherein the water flow adjustment valve has an axle disposed parallel to said rotary shaft.

6. A toilet seat box device according to claim 5, wherein said gears are disposed inside the housing adjacent the toilet seat side.

* * * * *